US005188534A

United States Patent [19]

Bertho et al.

[11] Patent Number: 5,188,534

[45] Date of Patent: Feb. 23, 1993

[54] SURFACE MOUNT CONNECTOR WITH CLIP ENGAGING CONTACTS

[75] Inventors: Dominique Bertho, Himiko Court, Singapore; Peter Roche, Corbally Limerick; Paddy McNamara, Tipperary, both of Ireland

[73] Assignee: Molex Incorporated, Lisle, Ill.

[21] Appl. No.: 854,508

[22] Filed: Mar. 19, 1992

[51] Int. Cl.[5] ..... H01R 9/09

[52] U.S. Cl. ..... 439/79; 439/629

[58] Field of Search ..... 439/55, 65, 66, 78, 439/79, 629, 630, 660

[56] References Cited

U.S. PATENT DOCUMENTS

| | | | |
|---|---|---|---|
| 3,215,968 | 11/1965 | Herrmann | 439/629 |
| 4,645,277 | 2/1987 | Kikuchi et al. | 439/630 X |
| 4,869,672 | 9/1989 | Andrews, Jr. | 439/630 X |
| 4,955,820 | 9/1990 | Yamada et al. | 439/876 X |
| 4,975,086 | 12/1990 | Reichardt et al. | 439/629 |
| 5,078,611 | 1/1992 | Tanigawa et al. . | |

FOREIGN PATENT DOCUMENTS

| | | | |
|---|---|---|---|
| 1431347 | 4/1976 | United Kingdom | 439/629 |

*Primary Examiner*—Larry I. Schwartz
*Assistant Examiner*—Khiem Nguyen
*Attorney, Agent, or Firm*—Stephen Z. Weiss

[57] ABSTRACT

A surface mount electrical connector includes an insulating housing having a through receptacle, the housing being mountable to a printed circuit board. A spring contact is mounted in the receptacle of the housing and includes a contact pad at one end exposed at the bottom of the housing for surface engaging a circuit trace on the printed circuit board. A contact cusp is formed from the opposite end of the spring contact and projects from the top of the housing for engagement by a complementary contact component. A mounting post is provided intermediate the ends of the spring contact for fixing in a mounting aperture in the housing. The spring contact is a planar stamped metal component disposed in the housing with the plane of the contact generally transverse to the top and bottom of the housing. The contact cusp is preloaded within the housing.

5 Claims, 3 Drawing Sheets

SURFACE MOUNT CONNECTOR WITH CLIP ENGAGING CONTACTS

FIELD OF THE INVENTION

This invention generally relates to the art of electrical connectors and, particularly, to a surface mount electrical connector which has contact springs adapted for use in IC chip reader systems.

BACKGROUND OF THE INVENTION

Various electrical connectors have been designed with an insulating housing and spring contacts designed for use in a chip card reader system. The spring contacts are biased outwardly of the housing for interconnection with other electronic components such as printed circuit boards and the like.

Such electrical connectors, particularly the spring contacts, heretofore have been fairly complicated and expensive to manufacture. Usually, the small spring contacts are stamped from sheet metal material and then must be formed into a particular configuration for mounting in the insulating housing and for projecting therefrom to establish appropriate interconnections.

This invention is directed to providing an electrical connector of the above type in which the spring contacts simply are stamped in their final configuration for mounting in the insulating housing, including various unique features, without going through any forming procedures.

SUMMARY OF THE INVENTION

An object, therefore, of the invention is to provide a new and improved surface mount electrical connector of the character described.

In the exemplary embodiment of the invention, the surface mount electrical connector includes an insulating housing having through receptacle means and means for mounting the housing on a printed circuit board. A spring contact is mounted in the receptacle means of the housing and includes a contact pad at one end exposed at the bottom of the housing for surface engaging a circuit trace on a printed circuit board, and a contact cusp at an opposite end projecting from the top of the housing for engagement by a complementary contact component.

Preferably, the spring contact is a planar stamped metal component disposed in the housing with the plane thereof generally transverse to the top and bottom of the housing.

A feature of the invention includes providing the spring contact with a mounting post intermediate its ends, with the housing being molded of a plastic material and having a mounting aperture into which the mounting post is secured. With the spring contact being stamped, barbs are stamped on the sides of the mounting post for digging into the plastic within the mounting aperture.

As disclosed herein, the receptacle means include a groove in the underside of the housing and a slot in the housing opening at the top thereof. The contact pad of the spring contact is rigidly mounted in the groove, and the contact cusp of the spring contact is freely movably located in the slot.

Another feature of the invention is the provision of means for preloading the contact cusp of the spring contact within the housing. As disclosed herein, the preloading means include a shoulder on the housing behind which the cusp end of the spring contact is biasingly engaged.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the FIGS. and in which:

DETAILED DESCRIPTION OF THE PREFERRED EMBODIMENT

Figure 1:
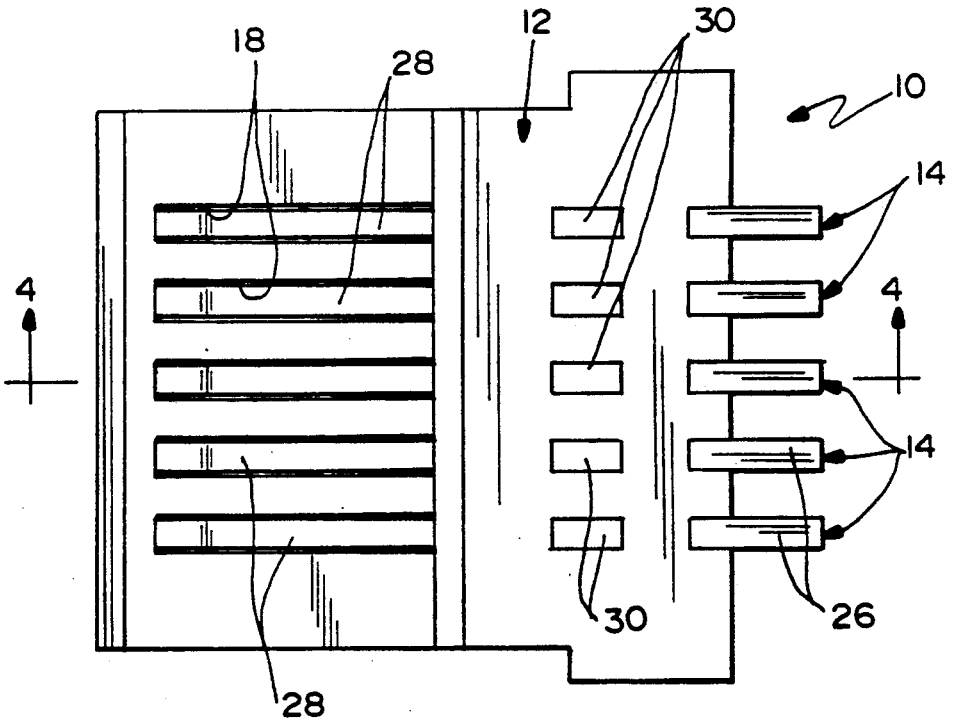
FIG. 1 is a top plan view of the electrical connector of the invention.

Referring to the drawings in greater detail, and first to FIGS. 1–4, the invention is embodied in a surface mount electrical connector, generally designated 10, which includes an insulating housing, generally designated 12, and a plurality of spring contacts, generally designated 14, mounted in the insulating housing.

Figure 3:
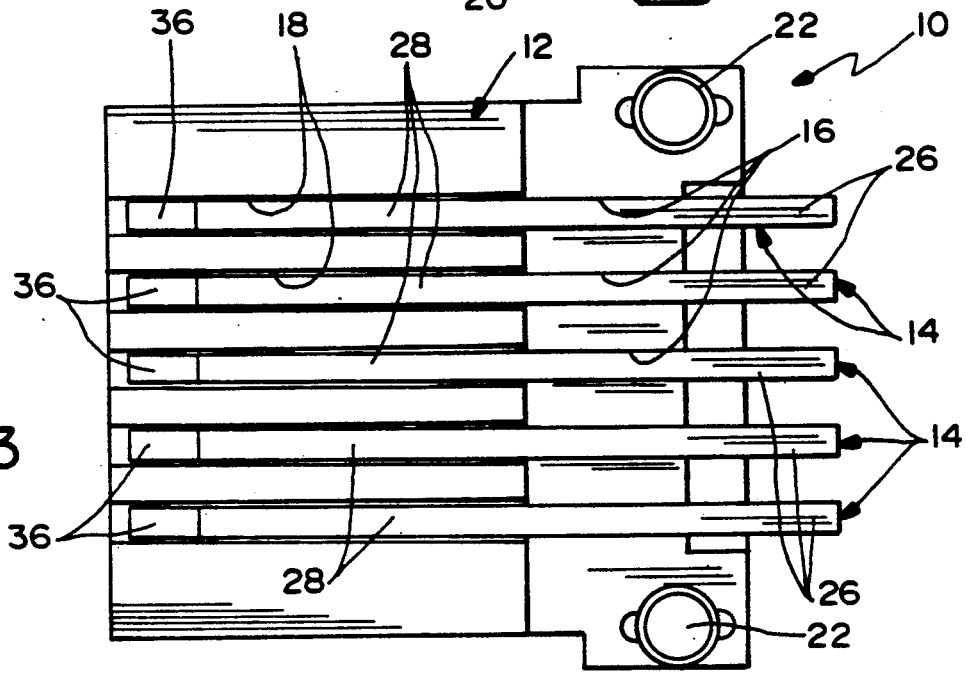
FIG. 3 is a bottom plan view of the electrical connector.
Figure 4:
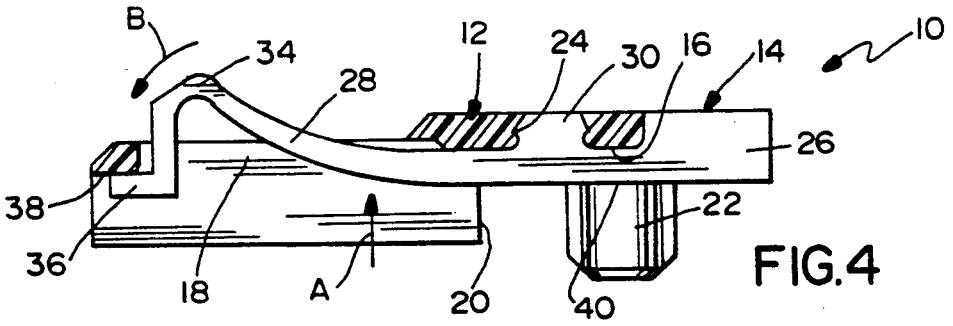
FIG. 4 is a vertical section taken generally along line 4—4 of FIG. 1.

Insulating housing 12 includes a plurality of through receptacle means, each receptacle means including a plurality of grooves 16 (FIG. 3) in the underside of the housing, and a plurality of through slots 18 (FIGS. 1 and 3) which open in the top of the housing as best seen in FIG. 4. The underside of the housing is stepped or notched, as at 20 (FIGS. 2 and 4), for providing a recessed area to receive an edge of a printed circuit board, as will be illustrated hereinafter. The housing further includes means in the form of a pair of mounting pegs 22 for mounting the housing in appropriate holes in the printed circuit board. Lastly, insulating housing 12 includes a mounting aperture 24 (FIG. 4) for facilitating mounting spring contacts 14 rigidly in the housing, as also described hereinafter. The housing, including all of the features described above, is unitarily molded in one-piece of dielectric material such as plastic or the like.

Figure 2:
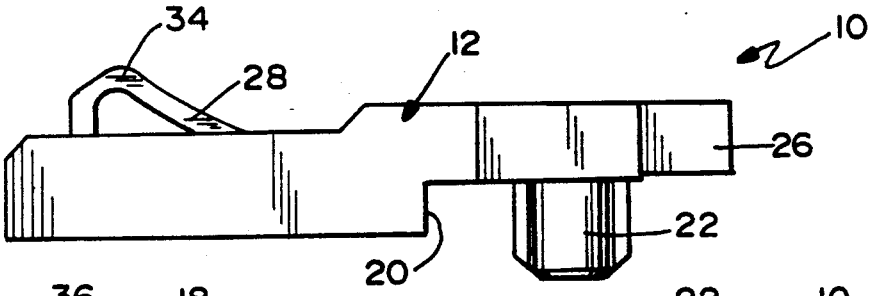
FIG. 2 is a side elevational view of the electrical connector.

As best seen in FIG. 4, but with continuing references to FIGS. 1–3, each spring contact 14 includes a contact pad portion 26 at one end, and a cusp forming spring arm 28 at the opposite end. A mounting post 30 is stamped intermediate the ends of each spring contact, and the post includes barbs 32 on the sides thereof for digging into the plastic material of the housing within mounting aperture 24.

It should be understood that such terms as "top", "bottom", "underside (above)", etc. are used herein and in the claims hereof for relative locational reference only, in that the connector is omni-directional in use, and no limitations are meant in using such terms.

Spring arm portion 28 of each spring contact 14 terminates in an inverted U-shaped stamped portion or cusp 34. The free leg of the cusp terminates in a distal end 36 of the spring contact arm, the distal end defining a flange which seats under a shoulder 38 of housing 12.

When each spring contact 14 is mounted within its respective receptacle means of housing 12, mounting post 30 is staked within mounting aperture 14 to rigidly mount the spring contact to the housing. When so mounted, contact pad portion 26 is located within a respective groove 16 in the housing such that the lower edge of the contact, as at 40, defines a contact pad for engaging a circuit trace on a printed circuit board mounted to the housing by mounting pegs 22. Spring arm portion 28 of the spring contact is freely movably located in a respective slot 18 of the housing, such that cusp 34 projects upwardly and outwardly of the housing. Spring arm 28 and, therefore, cusp 34 is preloaded by locating flange 36 behind shoulder 38 of the housing, the flange or distal end of the spring contact biasingly engaging shoulder 38.

In assembly, spring contacts 14 are inserted into housing 12 in the direction of arrow "A" (FIG. 4), with mounting posts 30 of the spring contacts entering respective mounting apertures 24 of the housing; with contact pad portions 26 of the contacts entering the grooves 16 in the housing; with spring arms 28 and cusps 34 entering slots 18 of the housing; and with flanges 36 engaging shoulders 38 of the housing to preload the spring arms and biasing the spring arms in the direction of arrow "B".

Figure 5:
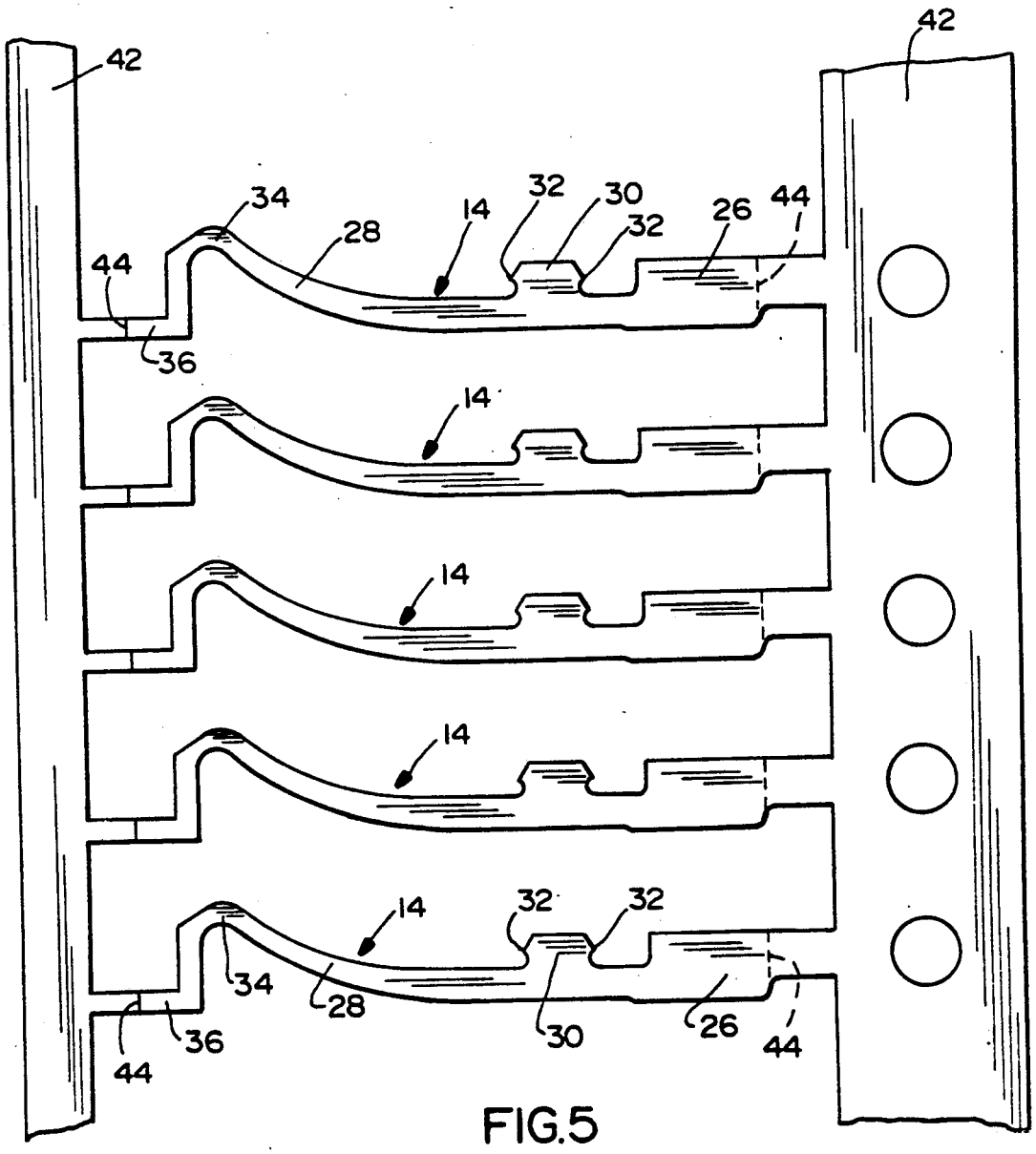
FIG. 5 is a fragmented section of a continuous metal strip showing plurality of the spring contacts being stamped there and still connected to carrier webs of the strip.

FIG. 5 shows how spring contacts 14 are stamped from flat sheet metal material in their final configurations and including all of the features described above. The contacts still are shown joined at opposite ends to carrier webs 42 as is conventional in continuous stamping operations. All of the features of each contact are illustrated, including mounting post 30, contact pad portion 26, spring arm 28, cusp 34 and preloading flange 36. Dotted lines 44 indicate where the contacts are to be severed from carrier webs 42 for insertion of the contacts into housing 12 as described in relation to FIG. 4.

Figure 6:
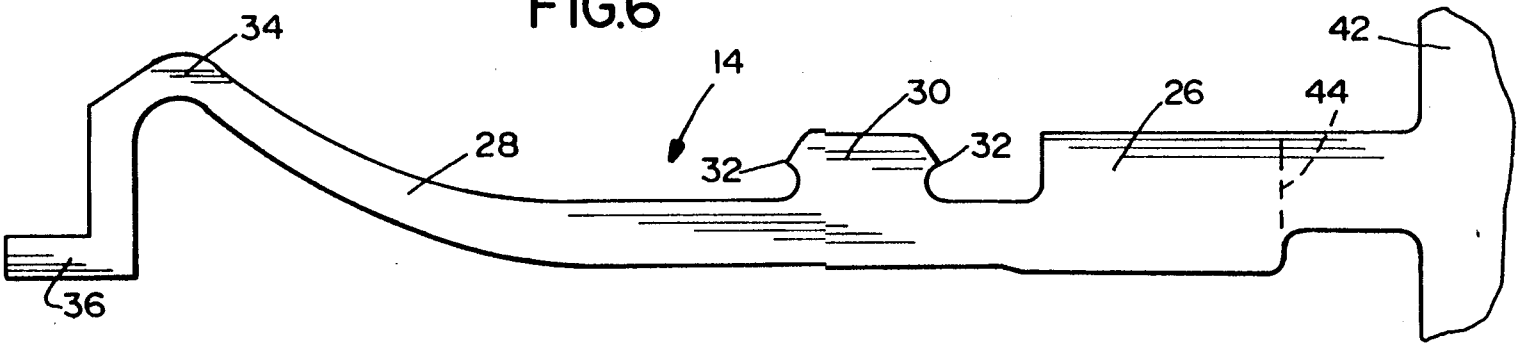
FIG. 6 is a view of one of the spring contacts separated from one of the carrier webs of FIG. 5.

FIG. 6 shows one of spring contacts 14 severed from one of the carrier webs 42 and isolated from housing 12. As seen in this figure, cusp 34 is shown shaded to indicate that the cusp may be plated with a highly conductive and non-corrosive material, such as gold. The plating operation can be carried out either while the contacts still are connected to one of the carrier webs 42 (FIG. 5) or after being severed from the webs.

Figure 7:
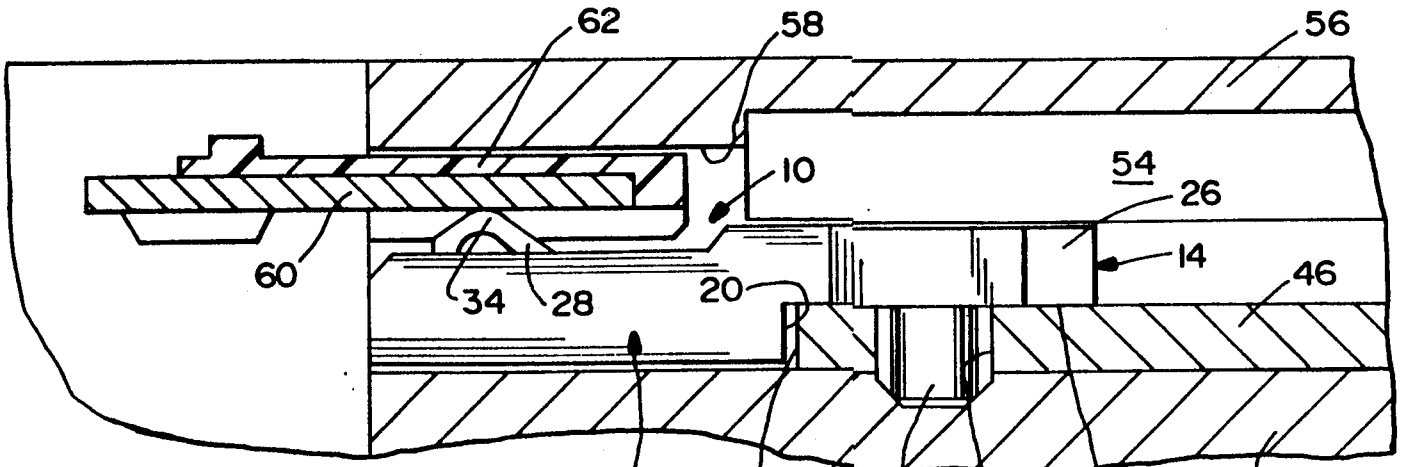
FIG. 7 is a fragmented, partially sectioned view of the electrical connector mounted to a printed circuit board and positioned for reading an IC chip.

FIG. 7 shows electrical connector 10 mounted to a printed circuit board 46 by means of inserting mounting pegs 22 in appropriate holes 48 in the printed circuit board. The board may be mounted to a substrate or body 50 of an appropriate apparatus. It can be seen that connector 10 is mounted to the printed circuit board along an edge 52 thereof, whereby the edge of the printed circuit board seats within the area of the underside of housing 12 provided by the stepped configuration 20 described above. Contact pads 40, defined by the lower edges of contact pad portions 26 of the spring contacts 14, engage appropriate circuit traces on top of printed circuit board 46. An LCD display 54 is located above connector 10 in the area of printed circuit board 46, the LCD display being fixed to the underside of a panel 56 of the apparatus with which connector 10 is being used. The panel, along with the front of LCD display 54, defines a receptacle 58 into which an IC chip 60 is inserted. The top and front of the chip is surrounded by a plastic holder 62, and the holder and chip are fixed to a frame 64 from which the chip protrudes for insertion into receptacle 58. When so inserted, circuits on the chip engage preloaded cusps 34 of spring contacts 14.

The apparatus described above in relation to FIG. 7 may be used in a blood glucose testing system, for instance. Specifically, blood sample test information is transferred from IC chip 60 in the form of electronic signals to printed circuit board 46, through electrical connector 10 of the invention. The printed circuit board is coupled to LCD display 54 to give a readout of the glucose content of the blood. Panel 56 may be transparent to allow visual observation of the LCD display.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A low profile surface mount electrical connector to electrically connect conductive elements on a planar surface of a first electrical component in close proximity with and parallel to a planar surface of a second electrical component, comprising:

an insulating housing having top and bottom surfaces and means for mounting a spring contact from the bottom surface of said housing including a plurality of grooves projecting into the housing from the bottom housing surface and a plurality of slots projecting into the housing from the top housing surface and communicating with said grooves where said grooves and slots are located in a plane perpendicular to said top and bottom housing surfaces, and means for mounting the housing on the first component planar surface with the top and bottom housing surfaces parallel to the first component planar surface; and a generally elongated spring contact mounted in the spring contact mounting means of the housing having the plane of the spring contact generally perpendicular to said first component planar surface and including a contact pad at one end exposed at the bottom of the housing for engaging a conductive element on the first component planar surface, a mounting post directed toward the top surface of said housing into a mounting aperture to which the mounting post is secured, and a contact cusp at an opposite end projecting from the top of the housing for engagement by a conductive element on the second component planar surface.

2. The surface mounting electrical connector of claim 1 wherein said housing is a molded plastic component and said spring contact is a stamped metal component, said mounting post including barbs for digging into the plastic material within the mounting aperture.

3. The surface mounting electrical connector of claim 1 wherein said contact cusp of the spring contact is freely movably located in the slot.

4. The surface mounting electrical connector of claim 1 including means for preloading the contact cusp of the spring contact within the housing.

5. The surface mounting electrical connector of claim 4 wherein said preloading means include a shoulder on the housing behind which said opposite end of the spring contact is biasingly engaged.

* * * * *